US006698517B2

(12) United States Patent
Simpson et al.

(10) Patent No.: US 6,698,517 B2
(45) Date of Patent: Mar. 2, 2004

(54) APPARATUS, METHODS, AND APPLICATIONS FOR EXPANDING TUBULARS IN A WELLBORE

(75) Inventors: Neil A.A. Simpson, Aberdeen (GB); Mark Hopmann, Alvin, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/990,092

(22) Filed: Nov. 21, 2001

(65) Prior Publication Data

US 2002/0079100 A1 Jun. 27, 2002

Related U.S. Application Data

(63) Continuation-in-part of application No. 09/828,508, filed on Apr. 6, 2001, which is a continuation of application No. 09/469,690, filed on Dec. 22, 1999.

(51) Int. Cl.[7] ..... E21B 43/06
(52) U.S. Cl. ..... 166/277; 166/278; 166/207
(58) Field of Search ..... 166/277, 278, 166/297, 384, 207, 227

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 2,383,214 | A | 8/1945 | Prout | |
| 2,499,630 | A | 3/1950 | Clark | |
| 2,627,891 | A | 2/1953 | Clark | |
| 2,663,073 | A | 12/1953 | Bieber et al. | |
| 2,898,971 | A | 8/1959 | Hempel | |
| 3,087,546 | A | 4/1963 | Woolley | |
| 3,195,646 | A | 7/1965 | Brown | |
| 3,353,599 | A * | 11/1967 | Swift | 166/207 |

(List continued on next page.)

FOREIGN PATENT DOCUMENTS

| | | | |
|---|---|---|---|
| EP | 0 952 305 A1 | 10/1999 | E21B/43/10 |
| EP | 0 961 007 A2 | 12/1999 | E21B/33/10 |
| GB | 1457843 | 12/1976 | B21D/39/10 |
| GB | 2 313 860 A | 12/1997 | E21B/10/34 |
| GB | 2 320 734 A | 7/1998 | E21B/33/127 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37771 | 6/2000 | E21B/43/10 |

OTHER PUBLICATIONS

PCT International Search Report, Internation Application No. PCT/GB 02/05022, dated Feb. 11, 2002.
U.S. patent application Ser. 09/462,654, Metcalfe, filed Dec. 19, 2000.
U.S. patent application Ser. 09/470,176, Metcalfe et al, filed Dec. 22, 1999.
U.S. patent application Ser. 09/469,690, Simpson, filed Dec. 22, 1999.
U.S. patent application Ser. 0/469,681 Metcalfe et al, filed Dec. 22, 1999.
U.S. patent application Ser. 09/469,643 Metcalfe et al, filed Dec. 22, 1999.
U.S. patent application Ser. 09/469,526 Metcalfe et al, filed Dec. 22, 1999.

*Primary Examiner*—William Neuder
(74) *Attorney, Agent, or Firm*—Moser, Patterson & Sheridan, L.L.P.

(57) ABSTRACT

The present invention relates to methods and apparatus for expanding tubulars in a wellbore. In one aspect of the invention, an expansion tool with hydraulically actuated, radially expandable members is disposed on a string of coil tubing. In another aspect of the invention the apparatus is utilized to expand a tubular lining a lateral wellbore into contact with a window of a larger tubular lining a central wellbore. The tubular lining can comprise nonporous or porous material.

10 Claims, 9 Drawing Sheets

U.S. PATENT DOCUMENTS

| | | | | | |
|---|---|---|---|---|---|
| 3,467,180 | A | | 9/1969 | Pensotti | |
| 3,818,734 | A | | 6/1974 | Bateman | 72/75 |
| 3,911,707 | A | * | 10/1975 | Minakov et al. | |
| 4,069,573 | A | | 1/1978 | Rogers, Jr. et al. | 29/421 |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,324,407 | A | | 4/1982 | Upham et al. | 277/27 |
| 4,429,620 | A | | 2/1984 | Burkhardt et al. | 91/395 |
| 4,502,308 | A | | 3/1985 | Kelly | 72/58 |
| 4,531,581 | A | | 7/1985 | Pringle et al. | 166/120 |
| 4,588,030 | A | | 5/1986 | Blizzard | 166/120 |
| 4,697,640 | A | | 10/1987 | Szarka | 166/120 |
| 4,848,469 | A | | 7/1989 | Baugh et al. | 166/382 |
| 5,271,472 | A | | 12/1993 | Leturno | 175/107 |
| 5,322,127 | A | | 6/1994 | McNair et al. | 166/313 |
| 5,366,012 | A | * | 11/1994 | Lohbeck | 166/277 |
| 5,409,059 | A | | 4/1995 | McHardy | 166/208 |
| 5,417,289 | A | | 5/1995 | Carisella | 166/387 |
| 5,435,400 | A | | 7/1995 | Smith | 175/61 |
| 5,469,919 | A | | 11/1995 | Carisella | 166/387 |
| 5,472,057 | A | | 12/1995 | Winfree | 175/57 |
| 5,495,892 | A | | 3/1996 | Carisella | 166/387 |
| 5,560,426 | A | | 10/1996 | Trahan et al. | 166/120 |
| 5,685,369 | A | | 11/1997 | Ellis et al. | 166/195 |
| 5,901,789 | A | | 5/1999 | Donnelly et al. | 166/381 |
| 6,021,850 | A | | 2/2000 | Wood et al. | 166/380 |
| 6,098,717 | A | | 8/2000 | Bailey et al. | 166/382 |
| 6,202,748 | B1 | | 3/2001 | Carisella et al. | 166/187 |
| 6,263,966 | B1 | | 7/2001 | Haut et al. | |
| 6,315,040 | B1 | | 11/2001 | Donnelly | |
| 6,325,148 | B1 | * | 12/2001 | Trahan et al. | 166/297 |
| 6,425,444 | B1 | * | 7/2002 | Metcalfe et al. | 166/387 |
| 6,457,533 | B1 | * | 10/2002 | Metcalfe | 166/381 |
| 2002/0144822 | A1 | * | 10/2002 | Hackworth et al. | 166/380 |

* cited by examiner

APPARATUS, METHODS, AND APPLICATIONS FOR EXPANDING TUBULARS IN A WELLBORE

CROSS-REFERENCE TO RELATED APPLICATIONS

This application is a continuation-in-part application of U.S. patent application Ser. No. 09/828,508, filed Apr. 6, 2001, which is a continuation of U.S. patent application Ser. No. 09/469,690, filed Dec. 22, 1999.

BACKGROUND OF THE INVENTION

1. Field of the Invention

The present invention relates to methods and apparatus for use in a wellbore; more particularly the invention relates to methods and apparatus for expanding tubulars in a wellbore and specific applications for the expanded tubulars.

2. Background of the Related Art

The drilling, completion and servicing of hydrocarbon wells requires the use of strings of tubulars of various sizes in a wellbore in order to transport tools, provide a path for drilling and production fluids and to line the wellbore in order to isolate oil bearing formations and provide support to the wellbore. For example, a borehole drilled in the earth is typically lined with casing which is inserted into the well and then cemented in place. As the well is drilled to a greater depth, smaller diameter strings of casing are lowered into the wellbore and attached to the bottom of the previous string of casing. Tubulars of an ever-decreasing diameter are placed into a wellbore in a sequential order, with each subsequent string necessarily being smaller than the one before it. This process of casing and cementing is commonly referred to as "completing" the well. In each instance, a sufficient amount of space must exist in an annular area formed between the tubulars in order to facilitate the fixing, hanging and/or sealing of one tubular from another or the passage of cement or other fluid through the annulus. Typically, when one tubular is hung in a wellbore, a slip assembly is utilized between the outside of the smaller tubular and the inner surface of the larger tubular therearound. One such assembly includes moveable portions, which are driven up cone-shaped members to affix the smaller tubular to the larger tubular in a wedging relationship.

Many of the above drilling and completion methods are also applicable for water wells. Typically, water wells are shallower than hydrocarbon producing wells, encounter lower formation pressures, and are budgeted for drilled and completed at costs significantly less than hydrocarbon producing wells.

Increasingly, lateral wellbores are created in wells to more fully or effectively access hydrocarbon bearing formations. Lateral wellbores are formed off of a vertical wellbore and are directed outwards through the use of a diverter, like a whipstock. After the lateral wellbores are formed, they are typically lined with a tubular creating a junction between the tubulars lining the vertical and lateral wellbores. The junction must be sealed to maintain an independent flow path in and around the wellbores. While prior art technologies have effectively provided means for forming and lining the lateral wellbore, operational effective and cost effective apparatus and methods for completing these wellbores are scarce or, in some situations, nonexistent. Conceptually, lateral water well boreholes can be drilled and completed, but costs are usually out of a normal budget range designated for typical water wells.

Multiple vertical and/or lateral wellbores are typically drilled into a hydrocarbon producing formation in a producing oil or gas "field". Early in the life of the field, fluids are typically produced from all wells. The produced fluid is typically a combination of hydrocarbon and water. As the field matures, the fraction of water in the produced fluid (typically referred to as the "water cut") increases as the level of the water-hydrocarbon interface within the formation increases, and internal formation pressures decrease. Eventually, it is not commercially feasible to produce high water cut wells, even though other wells within the field are producing fluids with commercially acceptable water cuts. In many cases, high water cut wells are converted from producing wells to "injection" wells. Another approach is to drill additional wells specifically for injection wells. Since these wells do not produce hydrocarbons, cost of drilling and especially cost of completion is a prime economic consideration. A variety of fluids, or combinations of fluids, are injected into the producing formation through injection wells. This injected fluid sweeps through the permeable producing formation to drive remaining hydrocarbons toward the wellbores of the field's producing wells. Injected fluids can comprise water, gas, hydrocarbons, surfactants, and a variety of combinations and injection sequences of these and other fluids. This process is broadly referred to as "enchanced" recovery.

In producing wells, whether hydrocarbon or water, it is highly desirable to control entry of particulate mater, such as sand, into tubulars within the producing wellbore. Particulates are typically filtered from produced fluids using a variety of screens, slotted liners and other tubular filtering means. These filtering means, which are typically set in other tubulars but which can also be set in uncased or "open" well boreholes, are known in the art. Conversely, in enhanced recovery injection wells, it is highly desirable to control entry of particulate mater into the formation since particulates tend to clog formation pore space and pore throats connecting the pore space thereby reducing formation permeability. A reduction in permeability decreases the efficiency of the enhanced recovery operation. Prior art teaches the use of various screens, slotted liners, gravel packs and the like to control movement of particulates in a dynamic wellbore fluid flow. All of these prior art methods result in operational and economic disadvantages as will be discussed in subsequent sections of this disclosure.

Economics also play an important role in the completion of hydrocarbon and water wells. As mentioned previously, formations penetrated by a borehole are hydraulically sealed from each other and from the borehole by cement, which is pumped into the casing-borehole annulus. Any means that can reduce the volume of this annulus reduces the required amount of cement which, in turn, reduces the cost of well completion. The cost of completion is further reduced if a hydraulic seal can be obtained directly between the outer surface of casing and the borehole wall, thereby eliminating the need for cementing. Gravel packs have been used to control inclusion of particulates in injection or water wells, especially when these wells are drilled into unconsolidated formations. Gravel packs are expensive and add significantly to the completion cost of the well. Sand screens have been used to control the flow of particulates, but are prone to collapse, especially when the pressure differential across the sand screen is directed alternately from borehole to formation and then from formation to borehole, as the case in "huff and puff" operations known in the art.

There is a need for apparatus and methods to quickly and easily position tubular filtering means in targeted formations within vertical and lateral wellbores. There is also a need for apparatus and methods to quickly and easily expand a tubular in a wellbore to a given diameter. There is a further need for apparatus and methods which position and expand tubular filters in boreholes to filter particulate material from fluid flowing between a formation of interest and the well borehole. There is yet a further need for methods and apparatus for expanding tubulars in a wellbore, which permit one tubular to be expanded into an opening formed in another tubular to create a filter for fluids flowing through the opening. There a further need for methods and apparatus permitting a tubular to be expanded within a well borehole thereby reducing the volume of an annulus formed by the outer surface of the tubular and the borehole wall thereby reducing cement volume required in completing the well. There is still a further need for methods and apparatus permitting a tubular to be expanded into an opening in a larger tubular or well borehole, wherein the expanded tubular will withstand pressures created by fluid injected into the larger tubular or borehole, through the expanded tubular, and into an earth formation penetrated by the borehole. There is yet a further need for methods and apparatus to expand a tubular to directly contact a well borehole wall thereby effectively completing the well without the necessity of cementing the tubular-borehole wall annulus.

U.S. Pat. No. 5,901,789 to Martin Donnelly et al discloses a deformable well screen, wherein the stated design criterion is to filter the flow of fluid from a formation penetrated by a borehole into the borehole. The filter device is expandable and utilizes a variety of relatively delicate filter materials including screens, meshes and even cloth. Physical robustness is provided by encasing the filter material between inner and outer expandable, perforated tubulars. When the device is expanded, the inner and outer tubulars prevent the filter element from being collapsed by pressure exerted by the formation into the borehole. The system is expanded from the "bottom up" by axially drawing a sized, conical member through the device. The system can not be expanded from the "top down". and no other means of axial conveyance are taught. In one embodiment of the device, a gravel pack is used to fill any voids between the borehole wall and the outer expandable perforated tubular. Wiper disks below the sized conical expansion member are used to sweep gravel from the borehole and into the voids. Because the wipers essentially block the borehole, fluid circulation can not be maintained within the borehole below the wipers. This can introduce significant operation and safety problems. The reference does not teach the completion of a well by expanding a solid tubular to form a hydraulic seal with the wall of a wellbore.

SUMMARY OF THE INVENTION

The present invention relates to methods and apparatus for expanding tubulars in a wellbore. In one aspect of the invention, an expansion tool with hydraulically actuated, radially expandable members is disposed on a string of coil tubing. The string of coil tubing is inserted into the wellbore from a reel at the surface of the well. In addition to providing transportation for the expansion tool into the wellbore, the coil tubing provides a source of hydraulic fluid from the surface of the well to actuate the expansion tool therebelow. A mud motor disposed on the coil tubing string above the expansion tool provides the expansion tool with rotary power. With the expansion tool lowered into a wellbore to a predetermined location within a tubular therearound, the expansion tool may be actuated and rotated and some portion of the tubular therearound expanded to a larger diameter.

In another aspect of the invention, an apparatus includes an expansion tool, a tractor and a mud motor disposed on a coiled tubing string. The tractor, with radially expandable members actuated by hydraulic fluid from the coiled tubing and rotated by the mud motor, propels the apparatus axially in the wellbore while the expansion tool expands the tubular therearound through radial force and rotation. In use, the apparatus is lowered into the wellbore from the surface of the well to a predetermined depth within a tubular therearound. Thereafter, the tractor is actuated by the mud motor and provides axial movement of the apparatus while the expansion tool rotates and expansion members thereupon are actuated to increase the diameter of a tubular therearound.

In another aspect of the invention, an apparatus is provided having an electric motor, at least one pump and a hydraulic fluid reservoir disposed in a housing with an expansion tool disposed therebelow. The apparatus is run into the well on a wireline which provides support for the weight of the apparatus and electrical power for the components therein. More specifically, the apparatus is lowered into a tubular in a wellbore to a predetermined depth. Thereafter, electric power supplied to the motor operates the pump to provide pressurized fluid to actuate the expansion tool and a shaft extending from the pump provides rotational power to the expansion tool.

In yet another aspect of the invention, the apparatus further includes a tractor run into the well on wireline along with the expansion tool and the housing enclosing the pump reservoir and motor. The electrical motor operates the pump which provides a source of pressurized fluid to the tractor and the expansion tool. Rotational force to the expansion tool and tractor is provided by an output shaft from the electric motor. In use, the tractor imports axial movement to the apparatus in the wellbore while the expansion tool rotates and expandable members thereupon increase the diameter of the tubular therearound.

In still another aspect of the invention, an apparatus includes a housing with two pumps and an electric motor disposed therein. Disposed above the housing is a tractor and disposed below the housing is an expansion tool. The apparatus is run into the wellbore on wireline which provides support for the weight of the apparatus and electrical power for the electric motor. In use, the electric motor provides power to an upper pump which actuates radially expandable members of the tractor thereby imparting axial movement to the apparatus in the wellbore. Additionally, the electric motor provides power to a lower pump which actuates the expansion tool therebelow. Both the expansion tool and tractor rotate to move the assembly axially in the wellbore and expand a longitudinal section of the tubular when desired.

In a further aspect of the invention, a method is provided using the apparatus of the present invention to position and expand tubular filters in boreholes to filter particulate material from fluid flowing between a formation of interest and the well borehole.

In another aspect of the invention, a method is provided for using the apparatus of the present invention to expanding tubulars in a wellbore which permits one tubular to be expanded into an opening formed in another tubular to create a filter for fluids flowing through the opening. A perforation in casing is an example of such an opening.

In yet another aspect of the invention, a method is provided using the apparatus of the present invention to permit a tubular to be expanded within a well borehole thereby reducing the volume of an annulus formed by the outer surface of the tubular and the borehole wall thereby reducing cement volume required in completing the well.

In a further aspect of the invention, a method is provided using the apparatus of the present invention to permit a tubular to be expanded into an opening in a larger tubular or well borehole, wherein the expanded tubular will withstand pressures created by fluid injected into the larger tubular or borehole, through the expanded tubular, and into an earth formation penetrated by the borehole.

In yet another aspect of the invention, a method is provided using the apparatus of the present invention to expand a tubular to directly contact a well borehole wall. This methodology can be used to effectively complete the well without the necessity of cementing the tubular-borehole wall annulus in order to obtain hydraulic isolation of the penetrated formations.

In still another aspect of the invention, a filter apparatus is expanded within the borehole to provide a means for removing particulate material from fluid injected into a formation in an enhanced recovery operation.

In a further aspect of the invention, a method is provided, using the apparatus of the present invention, to expand by rotation a tubular filter in another tubular to effect a substantially sealed junction and thereby provide filtration of injected fluids in a vertical or a lateral wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides apparatus and methods for expanding tubulars in a wellbore. Apparatus will first be discussed, followed by a discussion of methodology and applications.

Apparatus

Figure 1:
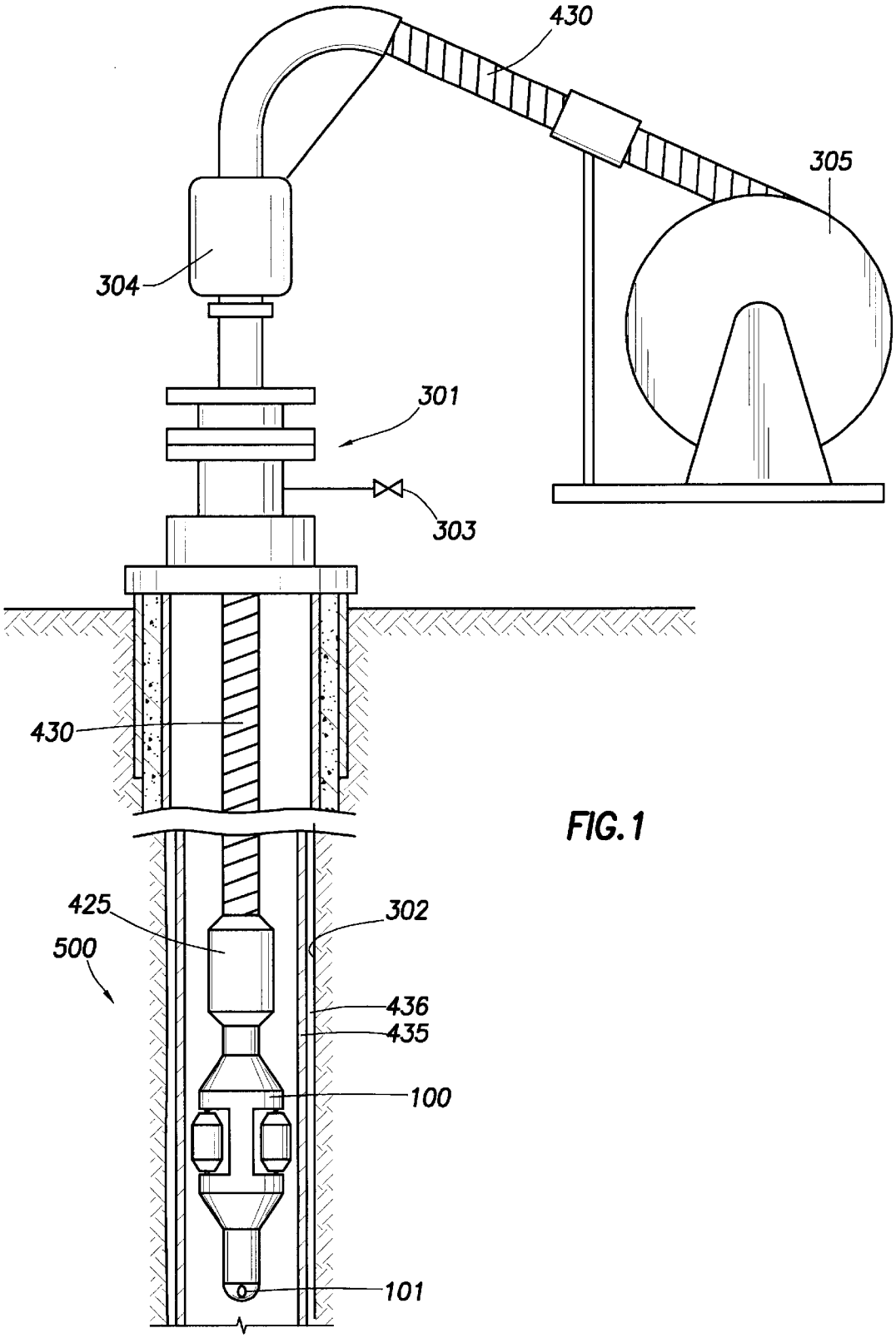
FIG. 1 is a partial section view of an apparatus for expanding a tubular in a wellbore comprising an expansion tool and a mud motor thereabove, both of which are disposed on a string of coil tubing.
Figure 2:
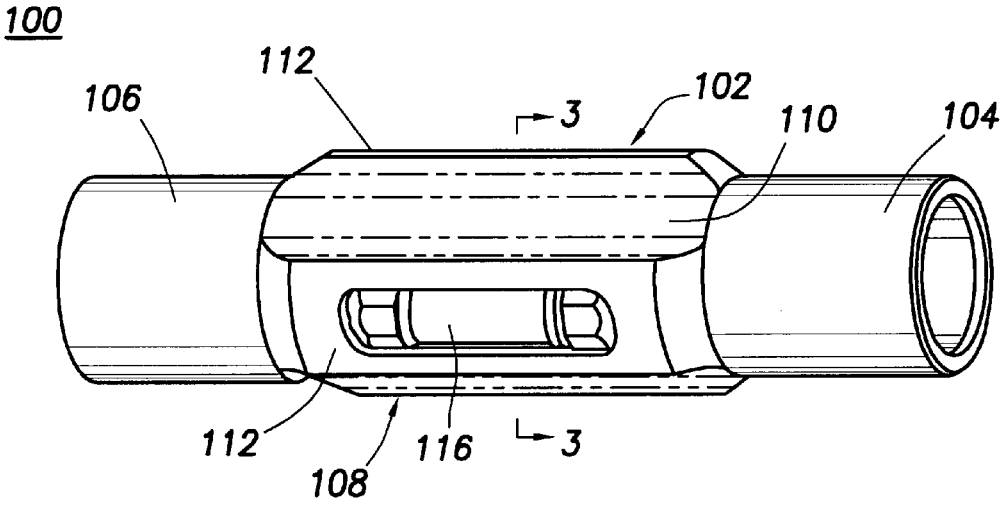
FIG. 2 is a perspective view of an expansion tool of the present invention.
Figure 3:
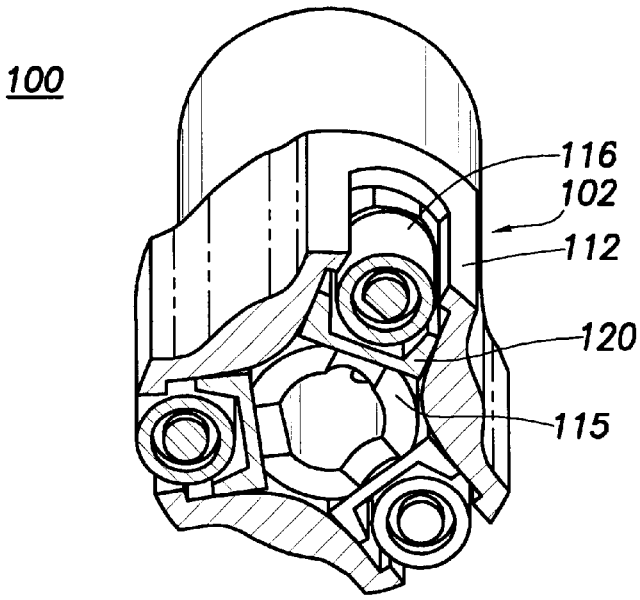
FIG. 3 is a perspective end view in section thereof.
Figure 4:
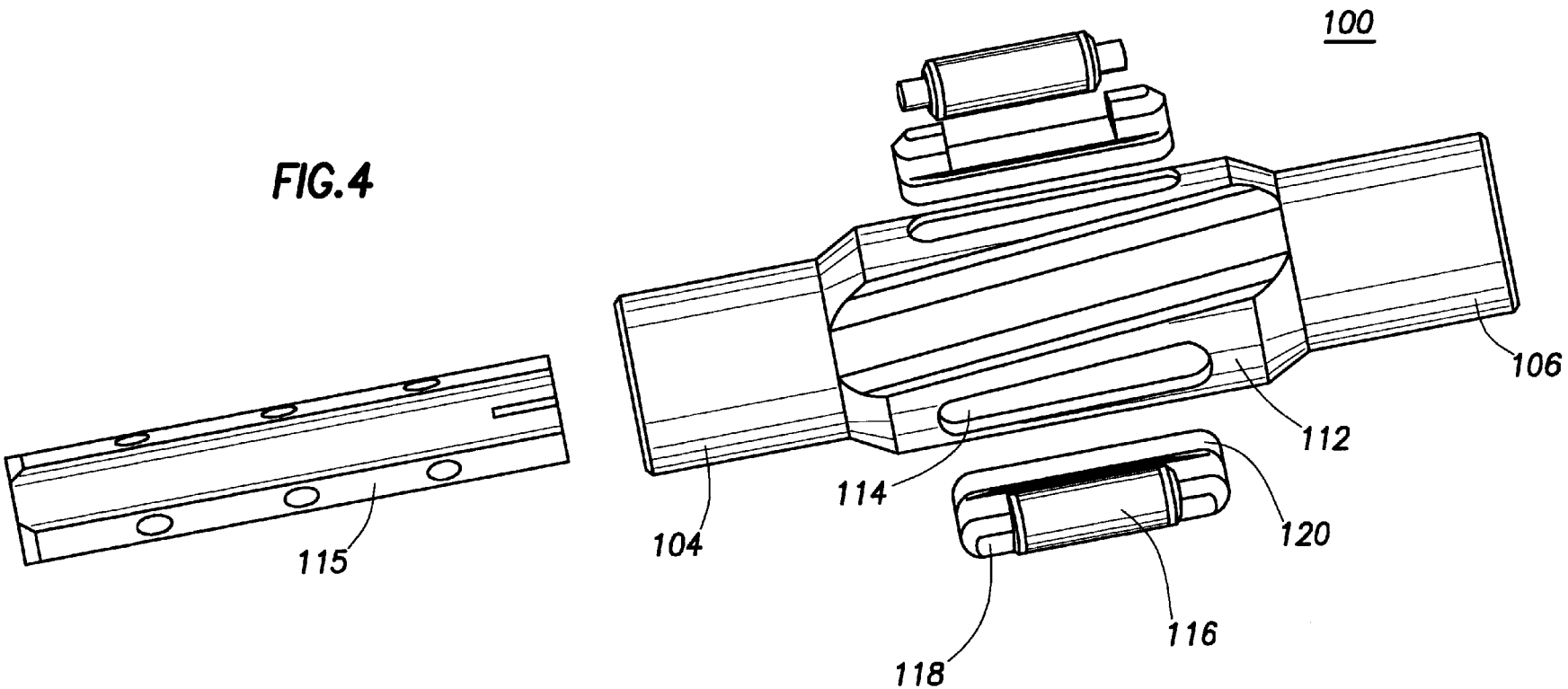
FIG. 4 is an exploded view of the expansion tool.

FIG. 1 is a section view illustrating an apparatus 500 according to one embodiment of the present invention in a wellbore 302. The apparatus 500 is shown in the interior of a tubular 435 and an annular area 436 is formed between the tubular 435 and the wellbore 302 therearound. At the surface of the well is a wellhead 301 with a valve 303 and a spool 305 of coil tubing 430. In the case of a pressurized wellbore, a stripper 304 or some other pressure retaining device is used in conjunction with the coil tubing string. The apparatus 500 includes an expansion tool 100 disposed at the lower end thereof. FIGS. 2 and 3 are perspective views of the expansion tool 100 and FIG. 4 is an exploded view thereof. The expansion tool 100 has a body 102 which is hollow and generally tubular with connectors 104 and 106 for connection to other components (not shown) of a downhole assembly. The connectors 104 and 106 are of a reduced diameter (compared to the outside diameter of the longitudinally central body part 108 of the tool 100), and together with three longitudinal flutes 110 on the central body part 108, allow the passage of fluids between the outside of the tool 100 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 100 to the exterior of the respective land 112. Each of the mutually identical rollers 116 is near-cylindrical and slightly barreled. Each of the rollers 116 is mounted by means of a bearing 118 at each end of the respective roller for rotation about a respective rotational axis which is parallel to the longitudinal axis of the tool 100 and radially offset therefrom at 120-degree mutual circumferential separations around the central body 108. The bearings 118 are formed as integral end members of radially slidable pistons 120, one piston 120 being slidably sealed within each radially extended recess 114. The inner end of each piston 120 (FIG. 3) is exposed to the pressure of fluid within the hollow core of the tool 100 by way of the radial perforations in the tubular core 115.

Referring again to FIG. 1, in the apparatus 500 of the present embodiment, fluid pressure to actuate the rollers 116 of the expansion tool 100 is provided from the surface of the well through a coiled tubing string 430. The expansion tool 100 of apparatus 500 includes at least one aperture 101 at a lower end thereof. Aperture 101 permits fluid to pass through the apparatus 500 and to circulate back to the surface of the well. Disposed above the expansion tool 100 and providing rotational forces thereto is a mud motor 425. The structure of mud motors is well known. The mud motor can be a positive displacement Moineau-type device and includes a lobed rotor that turns within a lobed stator in response to the flow of fluids under pressure in the coiled tubing string 430. The mud motor 425 provides rotational force to rotate the expansion tool 100 in the wellbore 302 while the rollers 116 are actuated against an inside surface of a tubular 435 therearound. The tubular 435 disposed around the apparatus of the present invention could be a piece of production tubing, or liner or slotted liner which requires either the expansion of a certain length thereof or at least a profile formed in its surface to affix the tubular within an outer tubular or to facilitate use with some other downhole tool. In FIG. 1, the annulus 436 between the tubular 435 and the wellbore 302 could be a void or could be filled with non-cured cement.

In use, the apparatus 500 is lowered into the wellbore 302 to a predetermined position and thereafter pressurized fluid is provided in the coiled tubing string 430. The pressurized fluid passes through the mud motor 425 providing rotational movement to an output shaft (not shown) that is connected to the expansion tool 100 to provide rotation thereto. In the preferred embodiment, some portion of the fluid is passed through an orifice or some other pressure increasing device and into the expansion tool 100 where the fluid urges the rollers 116 outwards to contact the wall of the tubular 435 therearound. The expansion tool 100 exerts forces against the wall of a tubular 435 therearound while rotating and, optionally, moving axially within the wellbore 302. The result is a tubular that is expanded past its elastic limits along at least a portion of its outside diameter. Gravity and the weight of the components urges the apparatus 500 downward in the wellbore 302 even as the rollers 116 of the expander tool 100 are actuated. Depending upon the requirements of the operator, a fluid path may be left between the expanded tubular and the wellbore in order to provide a flow path for fluids, including cement. For example, the tubular may be expanded in a spiral fashion leaving flute-shaped spaces for the passage of cement or other fluids.

Figure 5:
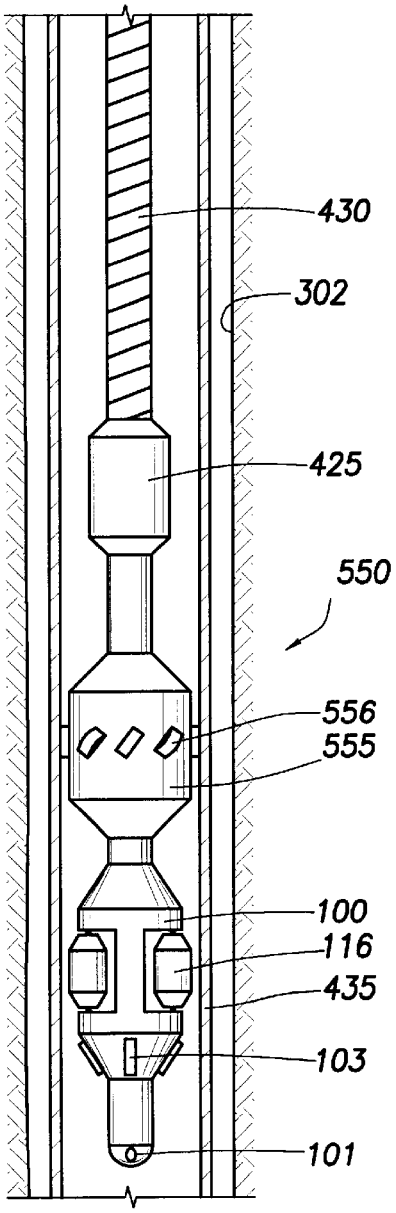
FIG. 5 is a section view of an apparatus including an expansion tool, a tractor disposed thereabove, a mud motor disposed above the tractor and a run-in string of coil tubing.

FIG. 5 is a section view of another embodiment of the invention. In the apparatus 550 of FIG. 5, a tractor 555 is disposed between the mud motor 425 and the expansion tool 100. The purpose of the tractor 555 is to provide axial movement to the apparatus 550 in wellbore 302 as the expansion tool 100 is actuated and increases the diameter of the tubular 435 therearound. The use of the tractor 555 is most advantageous when the apparatus 550 is used in a lateral wellbore or in some other circumstance when gravity and the weight of the components is not adequate to cause the actuated expansion tool 100 to move downward along the wellbore. The tractor 555 is also useful in case a specific and predetermined rate of movement of the apparatus is required for a particular activity. Additionally, the tractor 555 may be necessary if the apparatus 550 is to be used to expand the tubular 435 in a "bottom-up" fashion wherein the tractor provides upward movement of the apparatus 550 in the wellbore 302. The direction of axial movement of the tractor in the wellbore is selectable depending upon the orientation of the tractor when it is installed in apparatus 500. In the preferred embodiment, the rotational power to the tractor 555 is provided by the mud motor 425 disposed thereabove. Expandable elements 556 on the tractor allow it to achieve some degree of traction upon the inner walls of the tubular therearound. The expandable elements 556 are actuated by fluid pressure supplied through the coiled tubing string 430. Preferably, the expandable elements 556 have a radial travel adequate to contact the wall of a tubular even after the tubular has been expanded in diameter by the expansion tool 100. In use, the expansion tool 100 rotates while the rollers 116 disposed therearound are actuated and the tractor 555 simultaneously rotates with its actuated expandable elements to provide axial movement to the apparatus 550, typically in a downward direction. In use, the apparatus 550 is lowered into the wellbore 302 to a predetermined depth and thereafter, rollers 116 of the expansion tool 100 and expandable elements 556 of the tractor 555 are actuated with fluid pressure provided in the coiled tubing string 430. Simultaneously, the fluid in the coiled tubing string 430 operates the mud motor 425 and rotation is provided to the expansion tool 100 as well as to tractor 555 to propel the actuated expansion tool 100 downward in the wellbore 401.

Figure 6:
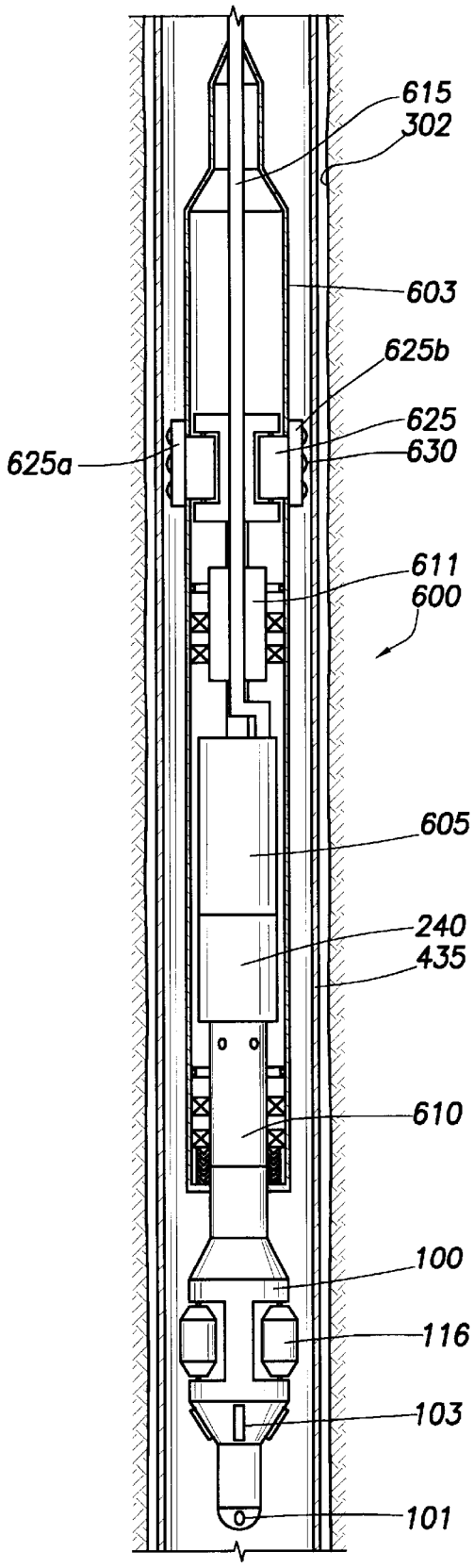
FIG. 6 is a view of an embodiment of the invention including a housing having an electrical motor, two pumps and an anchor assembly disposed therein, an expansion tool disposed below the housing and wireline used to insert the apparatus into a wellbore and to provide electrical power to the apparatus.

At a lower end of the expansion tool 100 shown in FIGS. 5 and 6 are a plurality of non-compliant rollers constructed and arranged to initially contact and expand a tubular prior to contact between the tubular and fluid actuated rollers 116. Unlike the compliant, fluid actuated rollers 116, the non-compliant rollers 103 are supported only with bearings and they do not change their radial position with respect to the body portion of the expansion tool 100.

FIG. 6 is an alternative embodiment of the invention illustrating an apparatus 600 with a housing 603 having an electric motor 605 and two pumps 610, 611 disposed therein and an expansion tool 100 disposed below. The apparatus 600 is run into the well on armored wireline 615 which provides support for the weight of the apparatus electrical power for the electric motor 605. The electric motor 605 is typically a brushless AC motor in a separate, sealed housing. An output shaft (not shown) extending from the electric motor 605 is coupled to and rotates an input shaft of pump 610 which, in turn, provides a source of rotational force to the expansion tool 100 therebelow. Separately, the electric motor operates the pump 610 which provides pressurized fluid to actuate the rollers 116 of the expansion tool 100. A closed reservoir (not shown) ensures a source of fluid is available to pumps 610, 611.

In order to direct rotation to the expansion tool 100 and prevent the housing 603 from rotating, the apparatus 600 is equipped with an anchor assembly 625 to prevent rotational movement of the housing 603 while allowing the apparatus 600 to move axially within the wellbore 302. The anchor assembly 625 is fluid powered by pump 611 which is also operated by the electric motor 605. The anchor assembly includes at least two anchoring members 625*a*, 625*b*, each equipped with rollers 630. The rollers 630, when urged against the wall of the tubular 435, permit the apparatus 600 to move axially. However, because of their vertical orientation, the rollers 630 provide adequate resistance to rotational force, thereby preventing the housing 603 from rotating as the pump 610 operates and rotates the expansion tool 100 therebelow.

A gearbox 240 is preferably disposed between the output shaft of the electric motor 605 and the rotational shaft of the expansion tool 100. The gearbox 240 functions to provide increased torque to the expansion tool. The pumps 610, 611 are preferably axial piston, swash plate-type pumps having axially mounted pistons disposed alongside the swash plate. The pumps are designed to alternatively actuate the pistons with the rotating swash plate, thereby providing fluid pressure to the components. However, either pump 610, 611 could also be a plain reciprocating, gear rotor or spur gear-type pump. The upper pump, disposed above the motor 605, preferably runs at a higher speed than the lower pump ensuring that the slip assembly 625 will be actuated and will hold the apparatus 600 in a fixed position relative to the tubular 435 before the rollers 116 contact the inside wall of the tubular 435. The apparatus 600 will thereby anchor itself against the inside of the tubular 435 to permit rotational movement of the expansion tool 100 therebelow.

Figure 7:
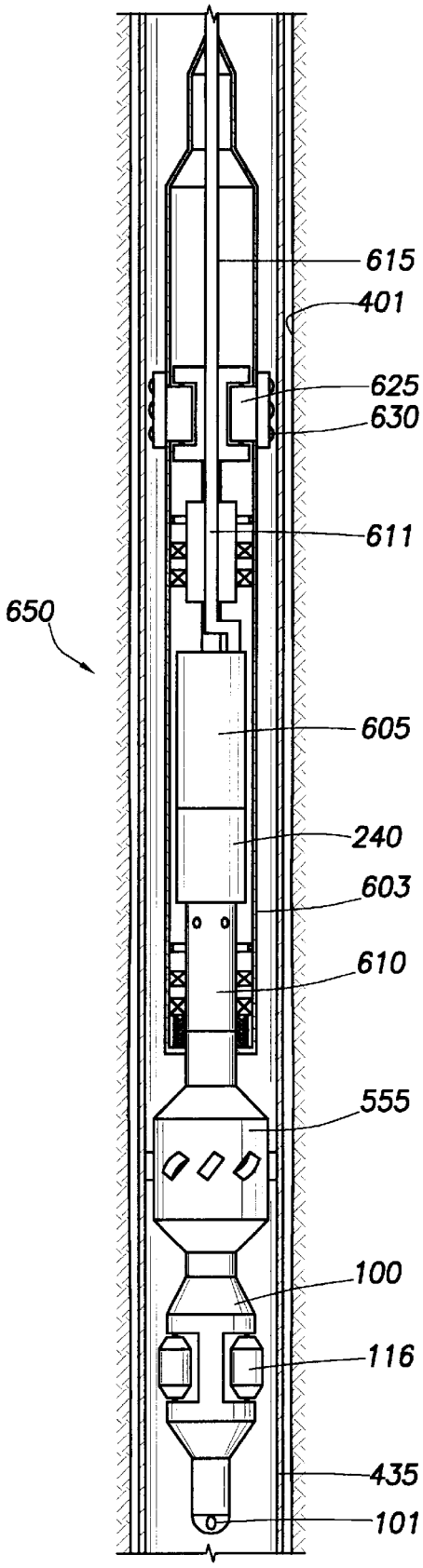
FIG. 7 is a partial section view of an apparatus of the invention including a housing having an electrical motor, a first and second pump and an anchor assembly disposed therein and a tractor and expansion tool disposed therebelow.

FIG. 7 is another embodiment of the invention. The apparatus 650 of FIG. 7 is similar to the embodiment illustrated in FIG. 6 with the addition of a tractor 555 disposed between the bottom of the housing 603 and the expansion tool 100. The components of the apparatus 650 are similarly numbered as those of apparatus 600 in FIG. 6. The tractor 555, like the tractor of the embodiment illustrated in FIG. 5, is designed to transport the entire apparatus 650 axially within the wellbore 401 as the expansion tool 100 is rotating and the rollers 116 of the expansion tool are actuated and are in contact with tubular 435 therearound. Like the embodiment of FIG. 6, the apparatus 650 is equipped with means to direct rotation to the tractor 555 and to the expansion tool 100 while preventing rotation of the housing 603. An anchor assembly 625 having rollers 630 disposed thereon is located at an upper end of the housing 603 and operates in a fashion similar the one previously described with respect to FIG. 6.

Figure 8:
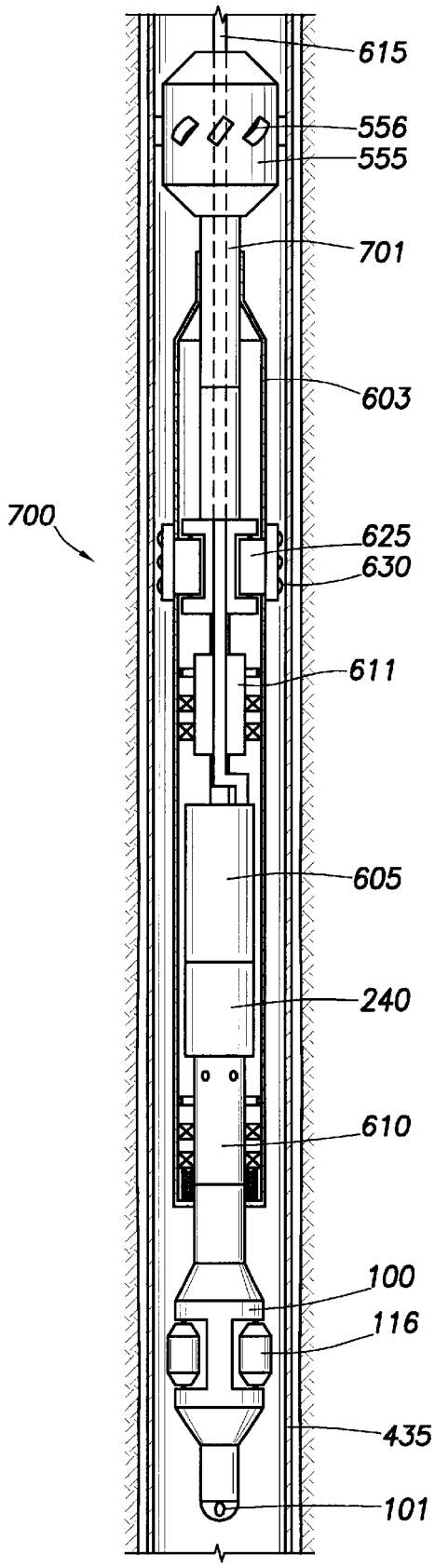
FIG. 8 is a section view of an alternative embodiment of the invention including a housing having an electrical motor, a first and second pump and an anchor assembly disposed therein, an expansion tool disposed below the housing and a tractor disposed above the housing.

FIG. 8 is yet another embodiment of the invention and is similar to the embodiments illustrated in FIGS. 6 and 7 and the like components are numbered similarly. In the apparatus 700 of FIG. 8, the tractor 555 is disposed on an upper end of housing 603. A tubular member 701 is disposed between the tractor and the housing and houses wireline 615 as well as a fluid path (not shown) between pump 611 and tractor 555. In apparatus 700, the electric motor 605 includes a shaft (not shown) extending to the tractor 555 and pump 611 to provide fluid power to the expandable elements 556 of the tractor 555 as well as to the anchor assembly 625. Like the embodiment of FIG. 7, the tractor is constructed and arranged to transport the entire apparatus 700 axially within the wellbore as the expansion tool 100 is rotating and the rollers 116 therearound are actuated to expand tubular 435 therearound.

Applications

Four applications of the invention will be discussed in detail. In the first application, the invention is used to expand a tubular lining a wellbore to seal and/or support the junction between the two wellbores. In the second application, the apparatus is used to expand a filter means over a set of perforations. In the third application, the apparatus is used to expand a tubular within a wellbore thereby reducing the tubular-borehole annulus and, in turn, reducing the amount of cement required to complete the well. In the fourth application, a tubular is expanded by the apparatus to obtain a seal directly against the borehole wall thereby eliminating the need for cement to successfully complete the well. The tubular can be non-porous thereby effectively casing the well without the necessity of a cement annulus for hydraulic sealing. Alternately, the tubular can be porous thereby providing a filter means for removing particulates from fluids flowing through the tubular. Although the embodiments of the apparatus described above are generally directed to oil and gas well applications, the embodiments are equally applicable in water wells, geothermal wells, disposal wells, wells leading to storage caverns, and the like. Stated another way, it should be understood that there are additional and equally pertinent applications for the disclosed apparatus and methods.

Figure 9:
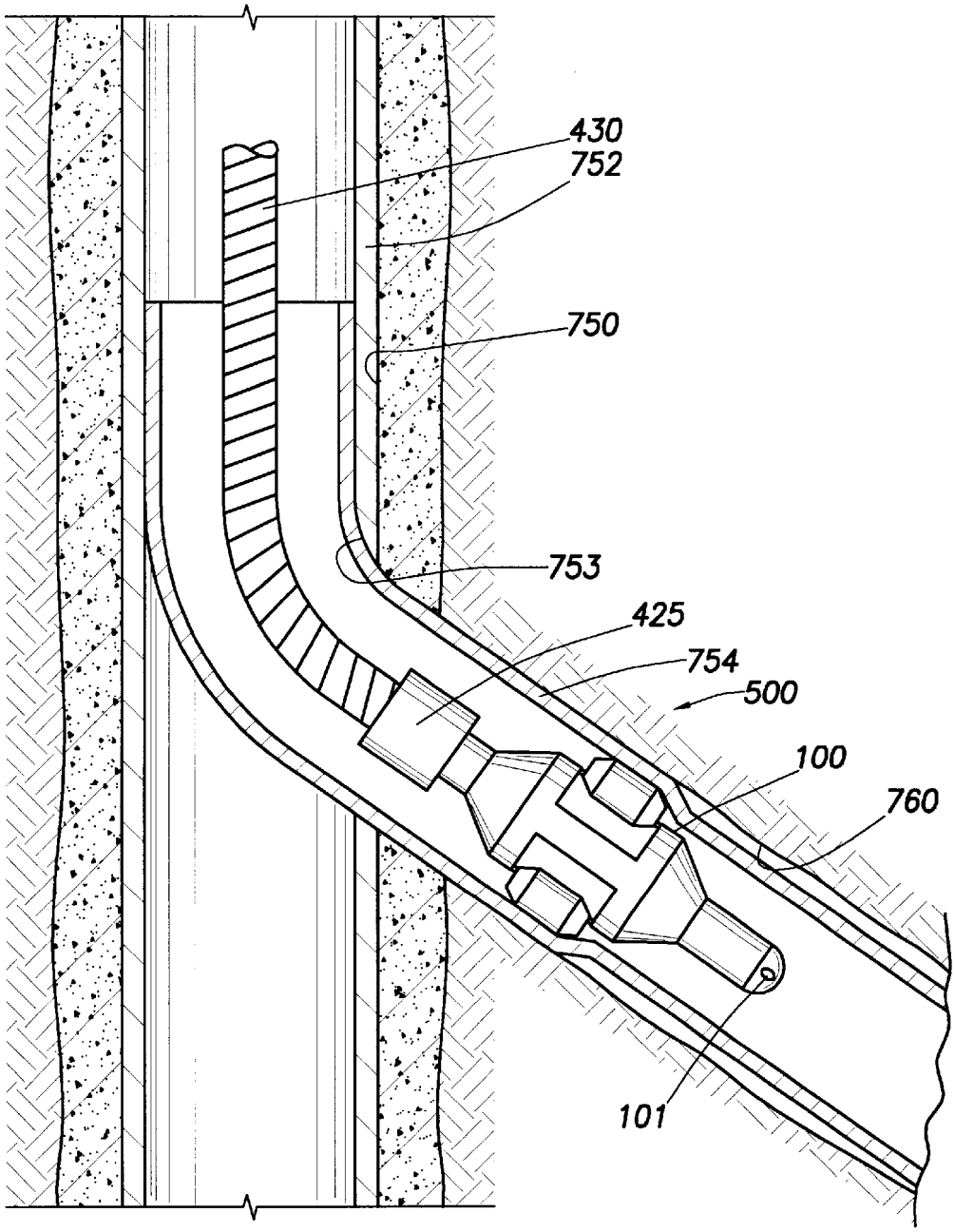
FIG. 9 is a section view of a cased vertical wellbore and a lateral wellbore whereby a tubular lining the lateral wellbore is expanded into a window formed in the casing of the vertical wellbore by an expansion tool with a mud motor thereabove.

FIG. 9 is a section view illustrating one method of using an apparatus 500 of the present invention. Specifically, the section view of FIG. 9 includes a vertical wellbore 750 having casing 752 therein and a lateral wellbore 760 which has been formed from the vertical wellbore. Typically, a vertical wellbore 750 is formed and thereafter, using some diverter like a whipstock (not shown), a window 753 is formed in the casing 752 of the vertical wellbore. Thereafter, a lateral borehole is drilled through the window 753. After the lateral wellbore 760 is formed, a string of tubulars 754 is inserted through the window 753 to line and complete the lateral wellbore 760. Thereafter, using the apparatus 500 of the present invention, the tubular lining the wellbore can be expanded in diameter to seal and/or support the junction between the two wellbores 750, 760. In FIG. 9, a first portion of the tubular 754 lining the lateral wellbore 760 has been selectively expanded into the window 753 between the vertical and lateral wellbores, while a lower portion of the tubular 754 remains at its initial, smaller diameter.

In use, the apparatus 500 of the present invention is be lowered into the wellbore after the lateral wellbore 760 has been formed and a tubular 754 located therein. The expansion tool 100 of the present invention is actuated through the use of the mud motor 425 at some position within the tubular 754, preferably above the window formed in the vertical wellbore casing 752. In order to increase the forward motion of the apparatus, a tractor (not shown) can be used in conjunction with the expansion tool 100. In this manner, the tubular is expanded above the window and as the actuated expansion tool 100 moves through the window 753, the tubular 754 is expanded into the window 753. The junction between the vertical wellbore 750 and the lateral wellbore 760 is in this manner substantially sealed and structurally supported. After tubular 754 is expanded, that portion of the tubular extending upwards from the window 753 towards the well surface can be remotely severed. The method can also be used in a "bottom-up" sequence wherein the tubular lining the horizontal wellbore is expanded from a first point upward through the window. Alternatively, the apparatus may be used to selectively expand slotted liner in the area of a junction between a main and a lateral wellbore. Also, various materials may be used between the interface of the expanded tubular and the window including material designed to effect and enhance a seal and to prevent axial and rotational movement between the outer surface of the expanded tubular and the window.

Figure 10:
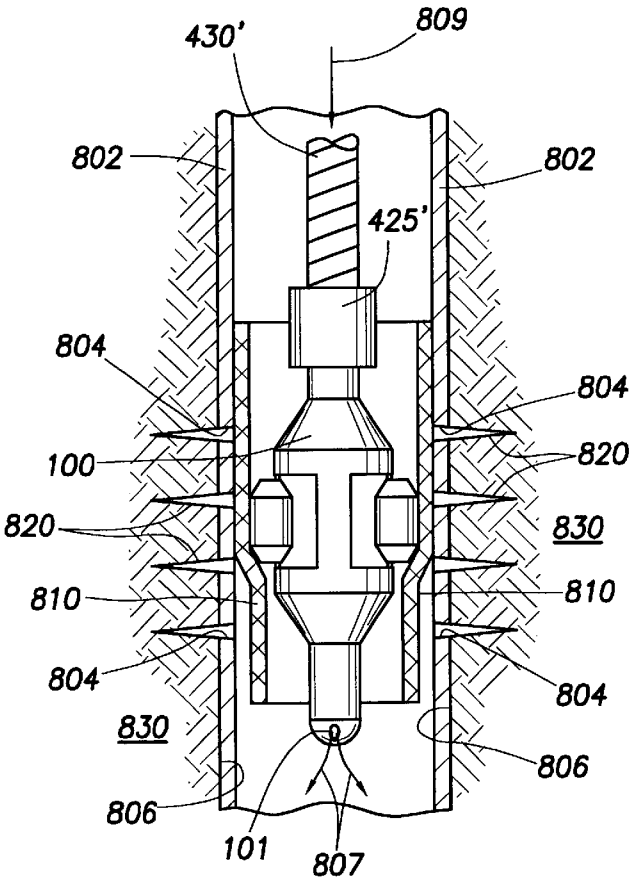
FIG. 10 is a sectional view of a cased wellbore with a tubular filter being expanded in a downward direction to seal against a set of perforations in a section of wellbore casing.

FIG. 10 is a sectional view of a wellbore 806 penetrating an earth formation 830. The wellbore 806 is cased with a tubular casing string 802. Typically, such a completed well would also contain a cement annulus between the casing 802 and the wall of the wellbore 806. The cement annulus has, however, been omitted for clarity. An essentially cylindrical tubular filter 810 is disposed within the casing 802 to encompass a series of radial flow conduits or "perforations" 804. The filter can comprise wire mesh, porous sintered material, netting, fabric and the like. The perforation procedure induces corresponding channels 820 within the formation, as is known in the art. FIG. 10 illustrates the essentially cylindrical filter 810 being expanded by a rotating expansion tool 100 moving axially downward as illustrated conceptually by the arrow 809. Rotation is provided by the element 425', and can be a mud motor, an electric motor, or any means of rotation as discussed in previous sections of this disclosure. An axial conveyance means 430' is illustrated, and can be a coiled tubing string, a wireline, or any means of axial conveyance discussed in previous sections of this disclosure. Axial conveyance can also be assisted by other means such as a tractor (not shown), as discussed in previous sections of this disclosure.

Still referring to FIG. 10, The filter 810 is being expanded past an elastic limit and therefore sealed against the perforations 804 in the casing 802 as the expansion tool moves axially downward. It should be noted that the filter 810 could also be expanded from the "bottom up" by reversing the axial motion of the expansion tool 100. The ability to expand from the "top down" or the "bottom up" is operationally advantageous in certain enhanced recovery operations where formation pressure, vertical formation communication, mechanical tubular setting or "landing" devices such as nipples and shoes must be considered. It should also be noted that fluid circulation within the casing 802 above and below the expansion tool 100 can be maintained during the expansion of the filter 810. This is possible since a wellbore flow conduit defined by the conveyance means 809, the hollow expansion tool 100 and the at least one aperture 101 remains open at all times during filter expansion. This feature is not available in some embodiments of previously discussed prior art devices, and is operationally advantageous in many facets of enhance recovery including pressure control.

Figure 11:
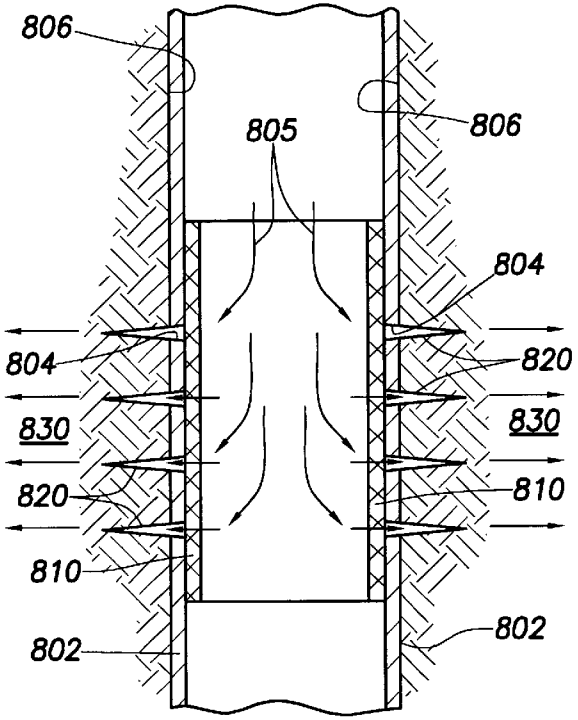
FIG. 11 is a sectional view of a cased wellbore with a cylindrical filter expanded and sealed against the perforations in the section of casing with fluid being injected through the filter and through the perforations and into the penetrated formation.

FIG. 11 is a sectional view of a cased wellbore with a cylindrical filter 810 fully expanded and sealed against the perforations 804 in the casing 802. Fluid, illustrated conceptually by the arrows 805, is injected through the filter 810, the perforations 804 and associated induced channels 820 into the formation 830. The filter 810 removes particulate material from the fluid thereby reducing the probability of clogging formation pore space and connecting pore throats. This, in turn, maintains the permeability of the formation 830 and thereby optimizes efficiency of the enhanced recovery operation. It is noted that cross sectional areas of perforations 804 vary, but a typical area is a few square inches or even less. Unless fluid injection pressures are very high, and/or the cross sectional areas if the perforations are abnormally large, no support structure is needed to support the portion of filter spanning the perforation. In addition, formation pressure or even formation matrix structure can provide support for the portion of filter spanning the perforation. Furthermore, injection pressure is a controllable parameter in an injection well of an enhance recovery project. Any and all of the above factors eliminate the need for inner and outer expandable tubular support members as taught by the previously discussed prior art system which is designed to filter fluid coming from the formation and into the borehole.

Figure 12:
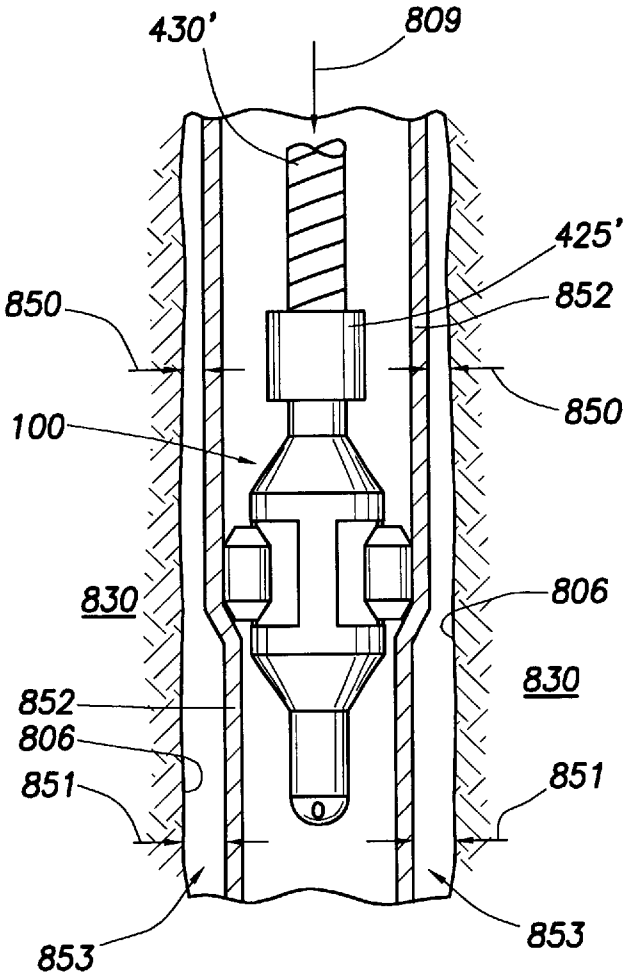
FIG. 12 is a sectional view of an expansion tool expanding a solid walled tubular to reduce the volume of the tubular-borehole wall annulus.

FIG. 12 is a sectional view of an expansion tool 100 expanding a nonporous, solid walled tubular 852 to reduce the volume of the tubular-borehole wall annulus 853. FIG. 12 illustrates the tubular 852, such as casing, being expanded by the rotating expansion tool 100 moving axially downward as illustrated conceptually by the arrow 809. Alternately, expansion can be from the bottom up as discussed previously. Rotation is provided by the element 425', and, as in the previous application example, can be a mud motor, an electric motor, or any means of rotation as discussed in previous sections of this disclosure. An axial conveyance means 430' is illustrated, and can be a coiled tubing string, a wireline, or any means of axial conveyance discussed in previous sections of this disclosure. Axial conveyance can also be assisted by other means such as a tractor (not shown), as discussed in previous sections of this disclosure.

Still referring to FIG. 12, the tubular 852 is expanded past an elastic limit as the expansion tool 100 moves axially downward. After expansion, the width 850 of the tubular-borehole wall annulus 853 is significantly smaller that the width 851 of the tubular-borehole wall annulus 853 prior to expansion of the tubular 852. Expansion, therefore, significantly reduces the volume of the tubular-borehole wall annulus 853 which, in turn, reduces the amount of cement required per axial increment to effectively complete the well penetrating a formation 830. This reduces completion costs.

Figure 13:
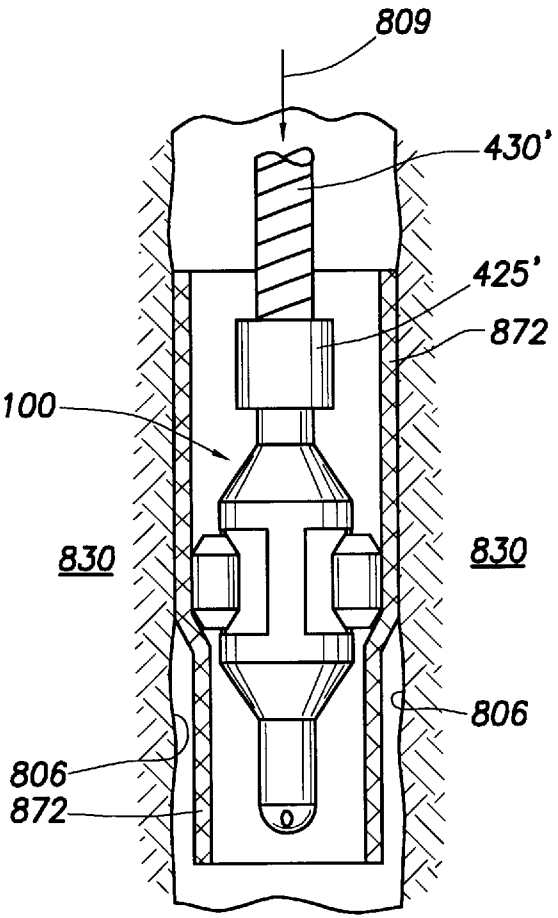
FIG. 13 is a sectional view of an expansion tool expanding a solid or a porous tubular to obtain a seal with the wall of a well borehole.

FIG. 13 is a sectional view of an expansion tool 100 expanding a nonporous or a porous tubular 872 to obtain a seal with the wall 806 of a well borehole. FIG. 13 illustrates the tubular 872 being expanded by the rotating expansion tool 100 moving axially downward as illustrated conceptually by the arrow 809. The tubing can alternately be expanded by moving the expansion tool 100 upward, as discussed in previous application examples. Rotation is once again provided by the element 425', and as in the previous application example, can be a mud motor, an electric motor, or any means of rotation as discussed in previous sections of this disclosure. An axial conveyance means 430' is illustrated, and can be a coiled tubing string, a wireline, or any means of axial conveyance discussed in previous sections of this disclosure. Axial conveyance can also be assisted by other means such as a tractor (not shown), as discussed in previous sections of this disclosure.

Still referring to FIG. 13, The tubular 872 is being expanded past an elastic limit as the expansion tool 100 moves axially downward thereby contacting the wall 806 of the well borehole penetrating the formation 830. If the tubular 872 is nonporous such as steel casing material, expansion effectively completes the well without the operational and economic cost of cementing. If the tubular is porous such as a screen, slotted liner or the like, a fluid filter means has been set in the formation 830. The tubular 872 requires no mechanical backup structure as discussed previously in the referenced prior art system. The tubular can also withstand a positive pressure differential from the borehole into the formation, or a positive pressure differential from the formation into the borehole. This provides fluid filtration means for fluid flowing from the formation into the borehole, which would be desired in a producing well. Conversely, fluid flowing from the borehole into the formation 830 would also be filtered, which would be desirable in an injection or disposal well.

Figure 14:
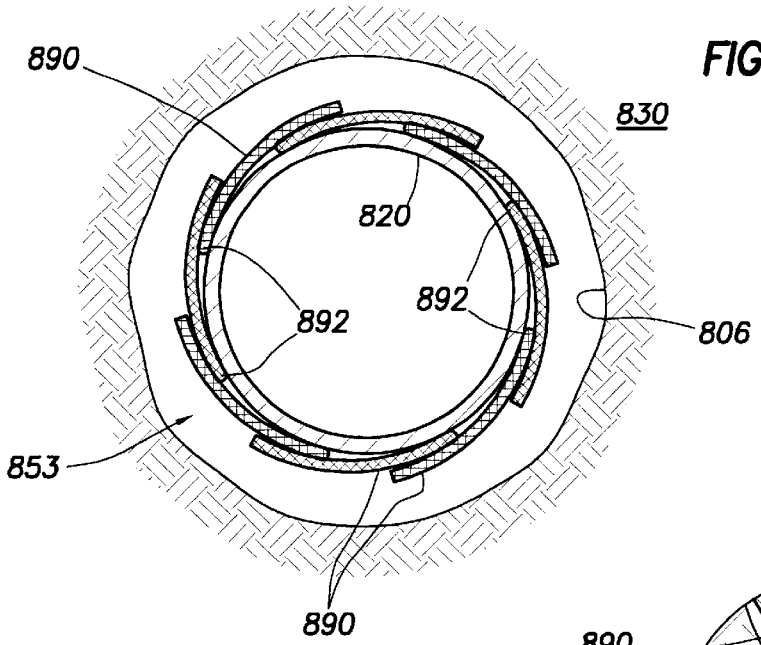
FIG. 14 is a sectional view of an expandable filter comprising panels mounted pivotally at one edge on an expandable carrier structure.

FIG. 14 is a sectional view of an expandable filter comprising a plurality panels 890 of porous filter materials. The panels can comprise screen, porous sintered material or the like. Eight panels 890 are illustrated, but as few as two or more than eight panels can be used. Each panel is pivotally mounted at a first edge 893 (better seen in FIG. 15)

on an expandable filter carrier 880 by a pivot means 892 such as a hinge. The filter carrier has opening to allow fluid flow therethrough. When deployed in an injection well, robustness is not required of the expandable carrier 880 since it is not load bearing. This will be discussed in more detail in the following paragraph. The filter panels are overlapped around the expandable carrier 880 and conveyed with a previously discussed conveyance means into a well borehole 853 penetrating a formation 830. When in a closed configuration as shown in FIG. 14, the filter panels 890 clear the wall 806 of the wellbore 853.

Figure 15A:
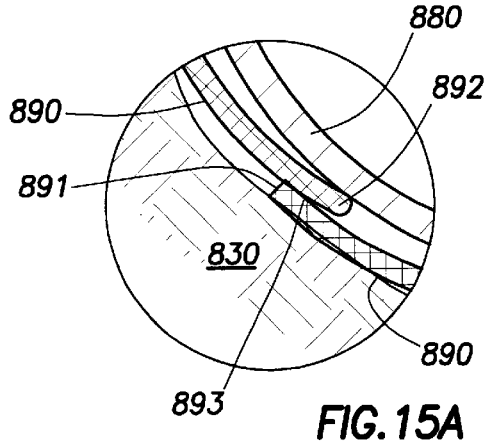
FIG. 15*a* is an enlarged view showing overlapped filter panels.
Figure 15:
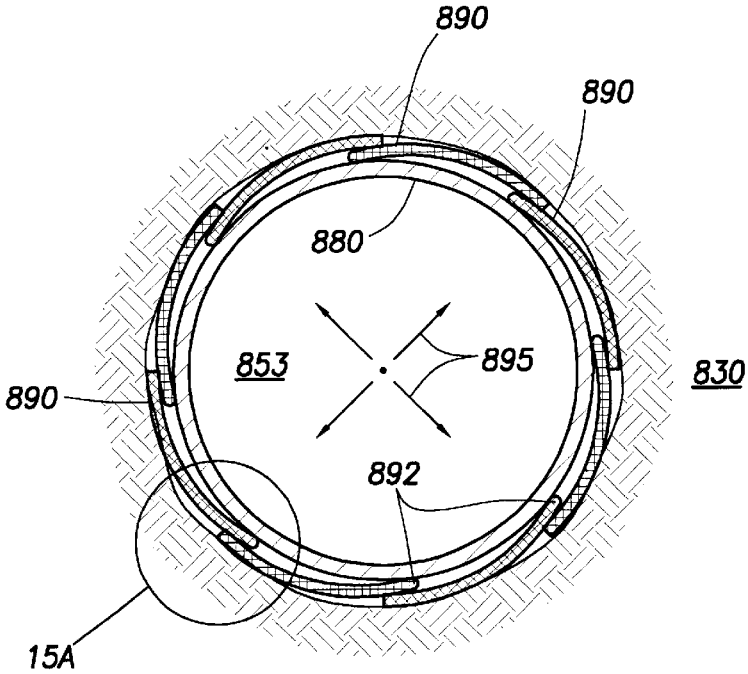
FIG. 15 is a sectional view of the expandable filter expanded within a borehole with the pivotally mounted panels overlapping and seated against the wall of a wellbore.

FIG. 15 is a sectional view of the expandable filter expanded within the wellbore 853. The carrier 880 is preferably expanded with an expansion tool as previously discussed. Upon expansion of the carrier 880, the panels 890 are pressed against the wall 806 of the wellbore. The panels 890 are sized so that a second edge 891 of a panel overlaps and contacts an adjacent panel, as shown more clearly in the exploded view in FIG. 15*a*. A filter seal is therefore formed circumferentially around the wellbore wall 806. As stated previously, the carrier 880 does not serve as a load member when the filter is used to filter fluid flowing from the wellbore 853 into the formation 830, as illustrated conceptually by the arrows 895. Pressure is directed from the wellbore and into the formation by the injection fluid. The formation 830 provides mechanical support for the panels 890 thereby preventing filter collapse.

It is noted that the expandable filter shown in FIGS. 14 and 15 is also applicable to wellbores containing tubulars which contain flow conduits, such as the cased, perforated well shown in FIGS. 10 and 11.

While the methods and apparatus of the present invention have been described in relative to wellbores of hydrocarbon wells, the aspect of the invention can also be utilized in geothermal walls, water wells, disposal wells, storage wells and any other settings where strings of tubulars are utilized in a wellbore.

While foregoing is directed to the preferred embodiment of the present invention, other and further embodiments of the invention may be devised without departing from the basic scope thereof, and the scope thereof is determined by the claims that follow.

What is claimed is:

1. An apparatus for filtering fluid flowing between a wellbore and a formation penetrated by said wellbore, comprising:

(A) an expandable filter disposable within said wellbore, wherein said expandable filter comprises:
- (a) an expandable carrier; and
- (b) a plurality of filter panels wherein
  - (i) each said filter panel comprises a first and a second edge,
  - (ii) each said filter panel is pivotally mounted on said expandable carrier at said first edge, and
  - (iii) each said filter panel contacts, at said second edge, an adjacent filter panel when said expandable carrier is expanded;

(B) an expansion tool, disposable within said expandable filter, the expansion tool rotatable to expand said expandable filter; and (C) axial conveyance means insertable within said wellbore to dispose said expansion tool within said expandable filter.

2. The apparatus of claim 1 wherein:

(a) each said filter panel contacts said formation when said expandable carrier is expanded; and (b) said formation provides mechanical support to said filter panels against pressure exerted upon said filter panels by fluid flowing from said wellbore and through said filter and into said formation.

3. The apparatus of claim 1 wherein said filter panels comprise screen.

4. A method for filtering fluid flowing between a wellbore and a formation penetrated by said wellbore, comprising the steps of:

(A) disposing an expandable filter within said wellbore, wherein said expandable filter comprises:
- (a) an expandable carrier; and
- (b) a plurality of filter panels wherein
  - (i) each said filter panel comprises a first and a second edge,
  - (ii) each said filter panel is pivotally mounted on said expandable carrier at said first edge, and
  - (iii) each said filter panel contacts, at said second edge, an adjacent filter panel when said expandable carrier is expanded;

(B) providing an axial conveyance means;

(C) disposing an expansion tool within said expandable filter using said axial conveyance means; and (D) rotating said expander tool to expand said expandable filter to contact said wellbore.

5. The method of claim 4 comprising the additional steps of:

(a) expanding said expandable carrier so that each said filter panel contacts said formation; and (b) mechanically supporting said filter panels against said formation thereby preventing collapse of said expandable filter by pressure exerted upon said filter panels by fluid flowing from said wellbore and through said filter and into said formation.

6. A method for expanding an expandable filter in a wellbore to remove particulate material from fluid flowing from said wellbore and through said filter and into a formation penetrated by said wellbore, the method comprising the steps of:

(A) axially conveying said expandable filter into said wellbore, wherein said expandable filter comprises:
- (a) an expandable carrier through which fluid can flow; and
- (b) a plurality of filter panels wherein
  - (i) each said filter panel comprises a first and a second edge,
  - (ii) each said filter panel is pivotally mounted on said expandable carrier at said first edge, and
  - (iii) each said filter panel contacts, at said second edge, an adjacent filter panel when said expandable carrier is expanded;

(B) disposing within said expandable filter an expander tool, the expander tool rotatable and having a plurality of radially expandable elements which expand upon rotation thereby expanding said expandable filter; and (C) flowing said fluid from said wellbore through said expanded filter thereby removing said particulate material before said fluid enters said formation.

7. The method of claim 6 comprising the additional steps of:

(a) expanding said expandable carrier so that each said filter panel contacts said formation; and (b) mechanically supporting each said filter panel against said formation thereby preventing collapse of said expandable filter by pressure exerted upon said filter panels by fluid flowing from said wellbore and through said filter and into said formation.

8. The method of claim 6 comprising the additional steps of:

(a) expanding said expandable carrier so that each said filter panel contacts an inner wall of a tubular within said wellbore, said tubular comprising at least one flow conduit through which said fluid flows; and (b) mechanically supporting each said filter panel against said inner wall and formation exposed by said flow conduit thereby preventing collapse of said expandable filter by pressure exerted upon said filter panels by fluid flowing from said wellbore and through said filter and through said at least one flow conduit and into said formation.

9. A method for expanding an expandable filter in a wellbore to remove particulate material from fluid flowing from said wellbore and through said filter and into a formation penetrated by said wellbore, the method comprising the steps of:

axially conveying said expandable filter into said wellbore, wherein said expandable filter comprises:

(a) an expandable carrier through which fluid can flow; and (b) a plurality of filter panels, wherein (i) each said filter panel comprises a first and a second edge, (ii) each said filter panel is pivotally mounted on said expandable carrier at said first edge, and (iii) each said filter panel contacts, at said second edge, an adjacent filter panel when said expandable carrier is expanded;

expanding said expandable filter toward said formation; and flowing said fluid from said wellbore through said expanded filter to remove said particulate material before said fluid enters said formation.

10. The method of claim 9, wherein expanding said expandable filter comprises:

expanding said expandable carrier so that each said filter panel contacts an inner wall of a tubular within said wellbore, said tubular comprising at least one flow conduit through which said fluid flows; and mechanically supporting each said filter panel against said inner wall and formation exposed by said flow conduit, thereby preventing collapse of said expandable filter by pressure exerted upon said filter panels by fluid flowing from said wellbore and through said filter and through said at least one flow conduit and into said formation.

* * * * *